US008305410B2

(12) United States Patent
Yamaguchi et al.

(10) Patent No.: US 8,305,410 B2
(45) Date of Patent: Nov. 6, 2012

(54) THERMAL HEAD UNIT AND THERMAL PRINTER WITH DRIVER IC ON FLEXIBLE SUBSTRATE

(75) Inventors: Toshio Yamaguchi, Shinagawa (JP); Masahiro Tsuchiya, Shinagawa (JP); Yukihiro Mori, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 274 days.

(21) Appl. No.: 12/796,736

(22) Filed: Jun. 9, 2010

(65) Prior Publication Data

US 2010/0321459 A1 Dec. 23, 2010

(30) Foreign Application Priority Data

Jun. 19, 2009 (JP) ..... 2009-146539

(51) Int. Cl.
*B41J 2/335* (2006.01)
*B41J 2/345* (2006.01)

(52) U.S. Cl. ..... 347/209

(58) Field of Classification Search ..... 347/200, 347/208, 209
See application file for complete search history.

(56) References Cited

U.S. PATENT DOCUMENTS

| | | | | |
|---|---|---|---|---|
| 7,443,408 | B2 | 10/2008 | Tozaki | |
| 2002/0041320 | A1 * | 4/2002 | Takizawa | 347/171 |

FOREIGN PATENT DOCUMENTS

| | | | | |
|---|---|---|---|---|
| CN | 101041300 | | 9/2007 | |
| JP | 5-193172 | * | 8/1993 | 347/209 |
| JP | 5-301360 | | 11/1993 | |
| JP | 6-64202 | * | 3/1994 | 347/209 |
| JP | 2006-27290 | | 2/2006 | |

OTHER PUBLICATIONS

Office Action dated Mar. 21, 2012 issued with respect to the corresponding Chinese Patent Application No. 201010208257.8.

* cited by examiner

*Primary Examiner* — Huan Tran
(74) *Attorney, Agent, or Firm* — IPUSA, PLLC

(57) ABSTRACT

A thermal head unit includes a head substrate having a heating element serving as a thermal head formed thereon, a flexible substrate, a driver IC disposed on the flexible substrate to drive the thermal head, and a heat sink attached to the head substrate and to the flexible substrate, wherein the driver IC and the flexible substrate are electrically connected to each other, and the driver IC and the head substrate are electrically connected to each other.

11 Claims, 11 Drawing Sheets

THERMAL HEAD UNIT AND THERMAL PRINTER WITH DRIVER IC ON FLEXIBLE SUBSTRATE

BACKGROUND OF THE INVENTION

1. Field of the Invention

The disclosures herein relate to a thermal head unit and a thermal printer.

2. Description of the Related Art

A thermal printer prints images by heating and driving a thermal head. With a thermal print unit having such a thermal head and platen, a compact thermal printer is easy to manufacture because the number of components is relatively small. Because of this, thermal printers are widely used in cash registers, portable terminal devices, ATMs (automatic teller machines), etc.

A thermal head is typically connected to a flexible substrate to form a thermal head unit. The flexible substrate of the thermal head unit is then connected to the core structure of a thermal printer. Control of image printing is performed through the flexible substrate.

Thermal printers used in the applications as previously described are required to have small numbers of components and to be manufactured at low cost. Especially, a thermal head unit inclusive of a thermal head is desired to be available at low cost.

Accordingly, it may be desirable to provide a thermal head unit that is manufactured at low cost by reducing the number of components constituting the thermal head unit and by reducing the number of steps of the production process. It may also be desirable to provide a low-cost thermal printer that employs such a thermal head unit.

[Patent Document 1] Japanese Patent Application Publication No. 2006-27290

SUMMARY OF THE INVENTION

It is a general object of the present invention to provide a thermal head unit and a thermal printer that substantially eliminate one or more problems caused by the limitations and disadvantages of the related art.

According to an embodiment, a thermal head unit includes a head substrate having a heating element serving as a thermal head formed thereon, a flexible substrate, a driver IC disposed on the flexible substrate to drive the thermal head, and a heat sink attached to the head substrate and to the flexible substrate, wherein the driver IC and the flexible substrate are electrically connected to each other, and the driver IC and the head substrate are electrically connected to each other.

According to an embodiment, a thermal printer includes a thermal head unit, a platen roller, and a sheet feed motor, wherein the thermal head unit includes a head substrate having a heating element serving as a thermal head formed thereon, a flexible substrate, a driver IC disposed on the flexible substrate to drive the thermal head, and a heat sink attached to the head substrate and to the flexible substrate, wherein the driver IC and the flexible substrate are electrically connected to each other, and the driver IC and the head substrate are electrically connected to each other.

According to at least one embodiment, a thermal head unit is manufactured at low cost to provide an inexpensive thermal printer.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments will be described by referring to the accompanying drawings.

First Embodiment

Thermal Head Unit

Figure 1:
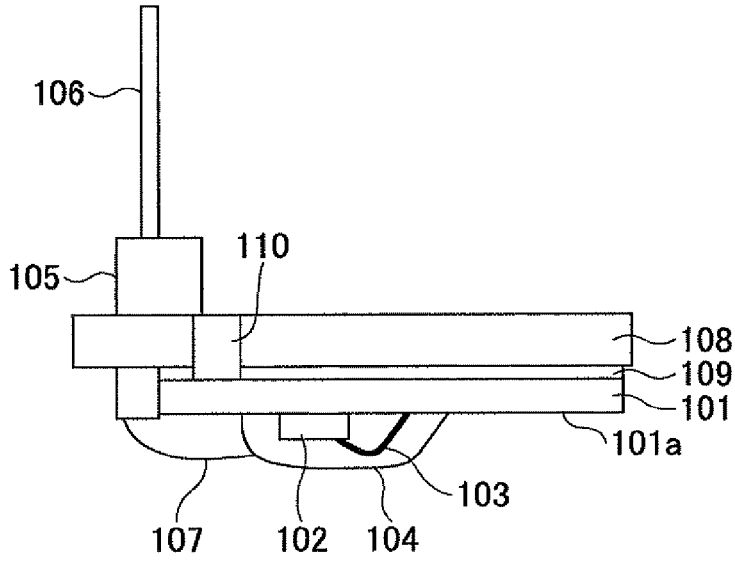
FIG. 1 is a drawing illustrating the configuration of a connector-type thermal head unit.
Figure 2:
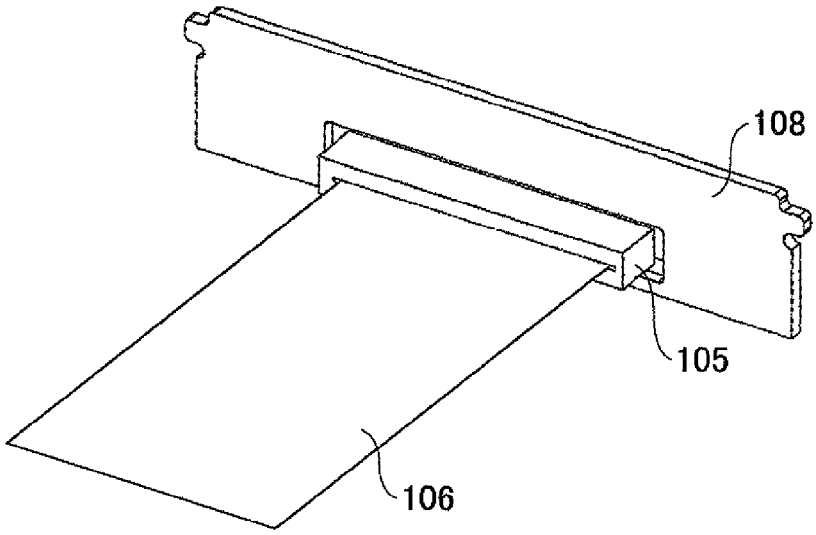
FIG. 2 is a perspective view of the connector-type thermal head unit.

In the following, a first embodiment will be described. A thermal head unit will be described first. FIG. 1 and FIG. 2 illustrate a connector-type thermal head unit in which a thermal head is connected to a flexible substrate through a connector.

In this thermal head unit, a heating element is provided on a surface 101*a* of a head substrate 101 made of ceramics. The heating element generates heat to form an image on a thermal paper sheet or the like. A driver IC 102 is mounted on the head substrate 101 to drive the heating element (i.e., thermal head), and is electrically connected to the head substrate 101 through wire bonding 103. The entirety of the driver IC 102 and wire bonding 103 is covered with an IC protective portion 104 made of resin material. An end of the head substrate 101 is connected to a connector 105 that is vertically positioned. A flexible substrate 106 is electrically connected to the head substrate 101 via the connector 105. A portion at which the head substrate 101 is connected to the connector 105 is covered with a connector-terminal protective portion 107 made of resin material. A heat sink 108 made of metal material such as aluminum is attached to a back face (i.e., the face opposite to the surface 101*a*) of the head substrate 101 through a double-faced adhesive tape 109. Further, a heat sink fixing part 110 made of resin material is provided to fix the heat sink 108 to the head substrate 101.

In the thermal head unit having the structure described above, the driver IC 102 is situated on the head substrate 101. With this configuration, the size of the head substrate 101, which is expensive due to the use of ceramics as its material, tends to be large. This contributes to the thermal head unit being expensive.

Figure 3:
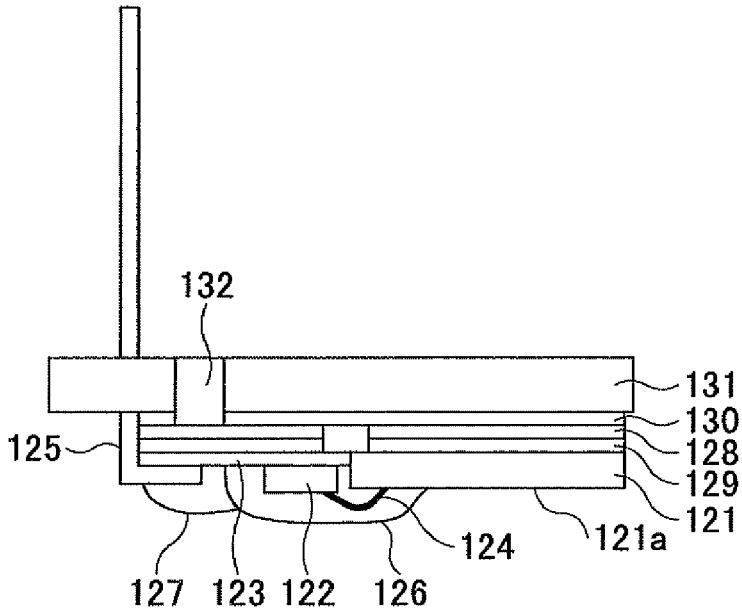
FIG. 3 is a drawing illustrating the configuration of a solder-type thermal head unit.

In the following, a description will be given of a thermal head unit having a reduced-size head substrate by referring to FIG. 3. This thermal head unit is sometimes referred to as a solder-type thermal head unit since the head is connected through solder. In this thermal head unit, as in the previously-described thermal head unit, a heating element is provided on a surface 121*a* of a head substrate 121 made of ceramics. A driver IC 122 is mounted on a printed substrate 123. The driver IC 122 and the head substrate 121 are connected to each other through wire bonding 124. The printed substrate 123 is connected through soldering to a flexible substrate 125. The entirety of the driver IC 122 and wire bonding 124 is covered with an IC protective portion 126 made of resin material. An entire portion at which the printed substrate 123 is connected through soldering to the flexible substrate 125 is covered with an FPC protective portion 127 made of resin material.

In the thermal head unit having the structure described above, the head substrate 121 and the driver IC 122 are connected through the wire bonding 124. With this configuration, a metal plate 128 made of stainless or the like is provided in order to prevent wire disconnection resulting from distortion or the like. One surface of the metal plate 128 is connected to the head substrate 121 and the printed substrate 123 through a double-faced adhesive tape 129. The other surface of the metal plate 128 is attached through a double-faced adhesive tape 130 to a heat sink 131 made of metal material such as aluminum. Further, a heat sink fixing part 132 made of resin material is provided to fix the heat sink 131 to the head substrate 121.

Figure 4:
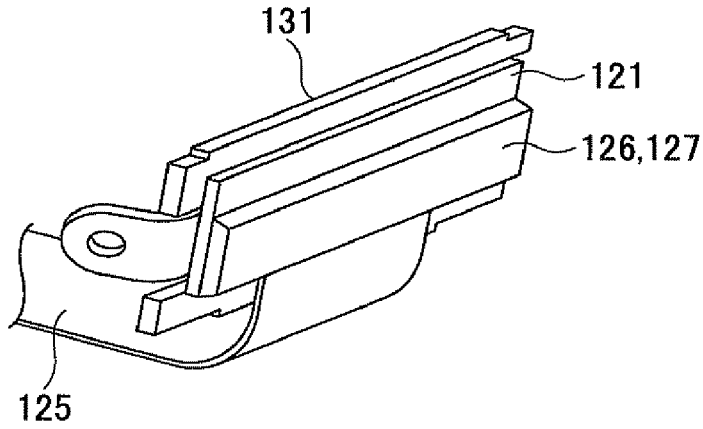
FIG. 4 is a perspective view of the solder-type thermal head unit.

FIG. 4 is a drawing illustrating an example of such a configuration of a thermal head unit. This thermal head unit has a configuration in which the IC protective portion 126 and the FPC protective portion 127 are integrated as a single, unitary structure.

Figure 5:
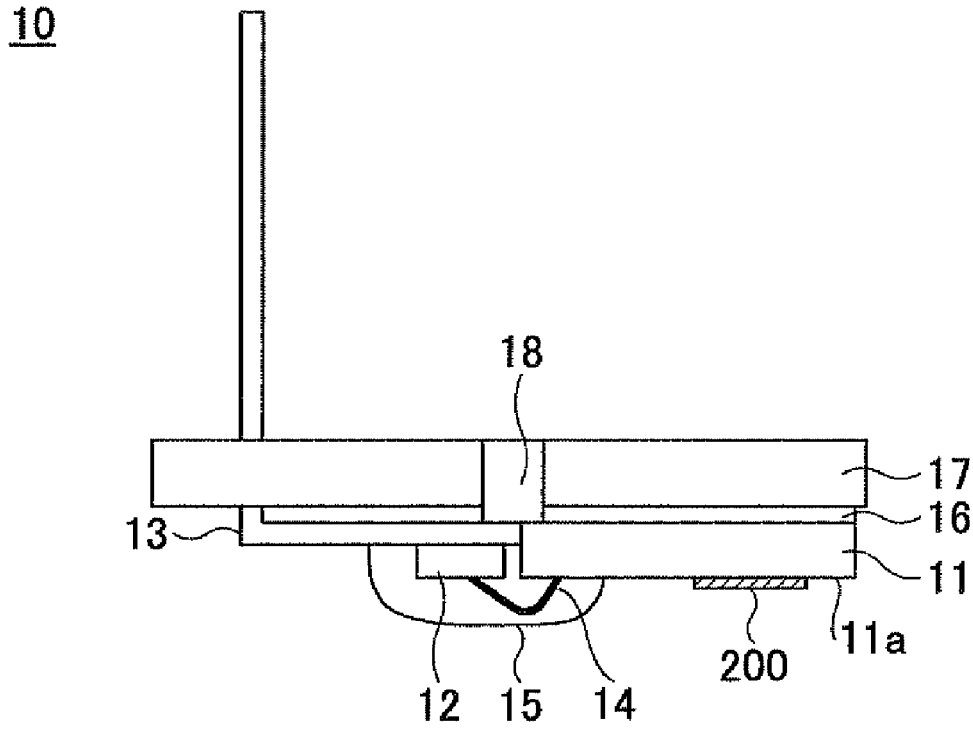
FIG. 5 is a drawing illustrating the configuration of a thermal head unit according to a first embodiment.

In the following, a description will be given of a thermal head unit 10 of the present embodiment by referring to FIG. 5. In the thermal head unit 10 of the present embodiment, as in the previously-described thermal head units, a heating element 200 is provided on a surface 11*a* of a head substrate 11 made of ceramics. A driver IC 12 drives the heating element 200 formed on the head substrate 11, so that an image is formed on a recording medium such as a thermal paper sheet by utilizing heat generated by the heating element 200. The driver IC is mounted on a flexible substrate 13, and is electrically connected to the flexible substrate 13. The driver IC 12 and the head substrate 11 are electrically connected to each other through wire bonding 14. The entirety of the driver IC 12 and wire bonding 14 is covered with an IC protective portion 15 made of resin material. The head substrate 11 and the flexible substrate 13 are attached to a heat sink 17 through a double-faced adhesive tape 16. Further, a heat sink fixing part made of resin material is provided to fix the heat sink 18 to the head substrate 11 and to the flexible substrate 13. The role of the heat sink fixing part 18 is auxiliary, and, thus, the heat sink fixing part 18 may only be provided as needed.

In the thermal head unit 10 of the present embodiment, there is no need to provide a metal plate to reinforce the printed substrate and wire bonding, so that it is easy to reduce the size of the head substrate 11. To be more specific, there is no danger of disconnecting the wire bonding 14 even without the use of a metal plate or the like because the head substrate 11 and the flexible substrate 13 are attached to the heat sink 17. This eliminates the need for a metal plate or the like. The thermal head unit can thus be manufactured at low cost.

The present embodiment has been described with respect to an example in which the driver IC 12 and the head substrate 11 are connected to each other through wire bonding 14. The method of connection is not limited to this example. The driver IC 12 and the head substrate 11 may be connected to each other through solder or through an anisotropic conductive film or the like.

Thermal Printer

In the following, a thermal printer of the present embodiment will be described. A thermal printer of the present embodiment is configured such that the thermal head unit 10 of the present embodiment illustrated in FIG. 5 is employed. In the following, a description will be given of a thermal printer of the present embodiment by referring to FIG. 6 and FIG. 7. The thermal printer of the present embodiment includes a platen roller 21, which is pressed against the head substrate 11 of the thermal head unit 10, with a print sheet 20 intervening therebetween. The thermal printer further includes a platen detachment detection switch 22 to detect the detachment of the platen roller 21, a sheet feed motor 23 to feed the print sheet 20, a head pressurizing spring 24 to press the head substrate 11 of the thermal head to the platen roller 21, a sheet detection sensor 25, and a printer control substrate 31.

In the thermal printer of the present embodiment, thermal paper is used as the print sheet 20. Thermal paper is supplied from a thermal paper roll 26 to a gap between the platen roller 21 and the head substrate 11 by the sheet feed motor 23. The sheet detection sensor 25 is a reflective-type optical sensor, which detects the presence and absence of the print sheet 20. The sheet feed motor 23 is connected through soldering to the flexible substrate 13. The printer control substrate 31 is connected to the flexible substrate 13. Specifically, the printer control substrate 31 has a printer control IC 32, other electronic components, and a connector 33 mounted thereon. The printer control IC 32 serves as a control circuit to control the thermal printer. The printer control substrate 31 is connected to the flexible substrate 13 such that a terminal part 13*a* of the flexible substrate 13 is inserted into the connector 33.

The head pressurizing spring 24 is situated between the heat sink 17 of the thermal head unit 10 and a plate-shape part 27 that is part of the chassis of the thermal printer. The plate-shape part 27 is fixedly positioned, and the head pressurizing spring 24 applies a force in such a direction to widen a gap between the plate-shape part 27 and the heat sink 17. Accordingly, the head substrate 11 of the thermal head unit 10 is pressed against the platen roller 21.

Figure 8:
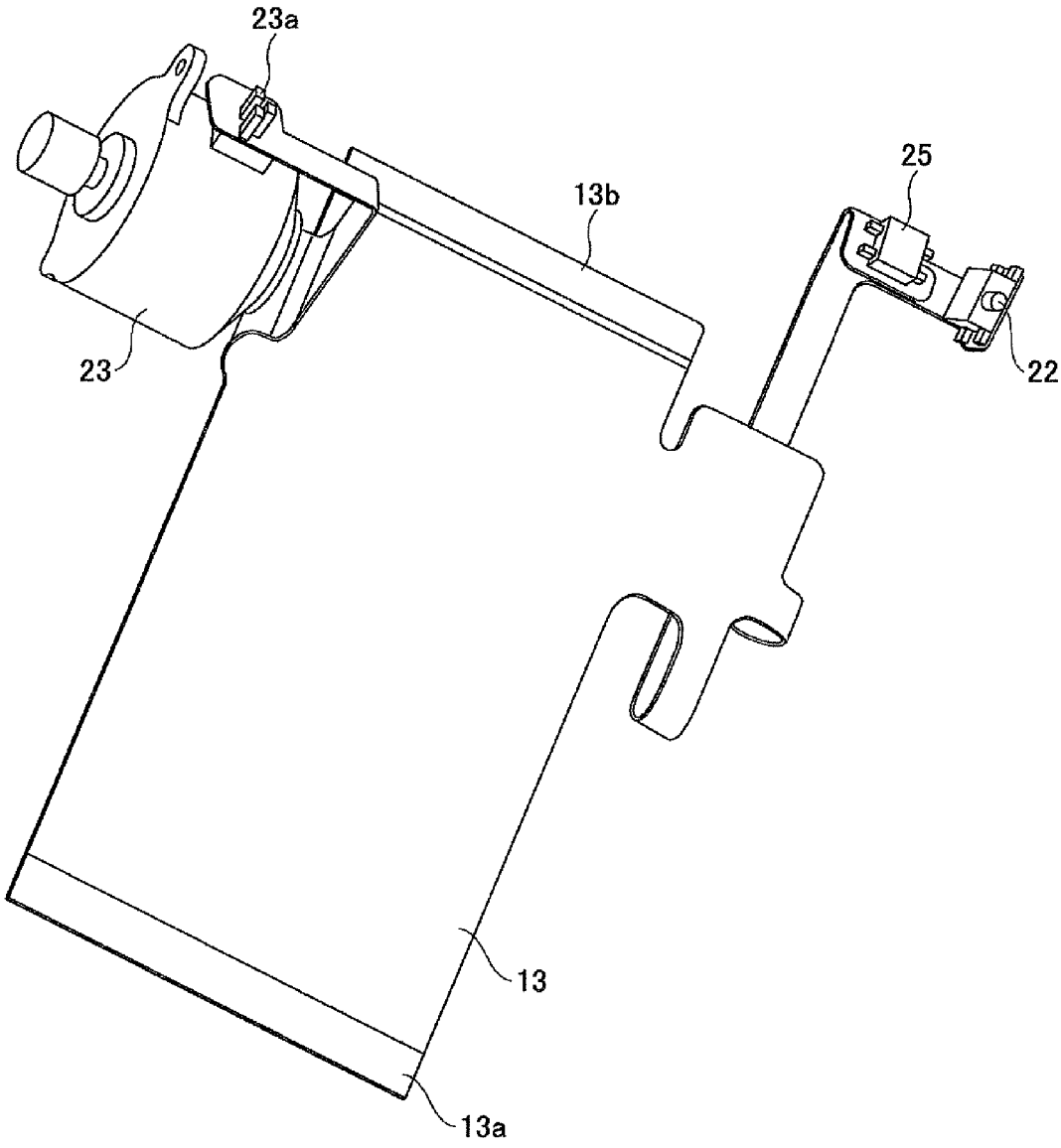
FIG. 8 is a drawing illustrating the configuration of a flexible substrate according to the first embodiment.

In the following, a description will be given of the flexible substrate 13 of the thermal head unit 10 of the present embodiment by referring to FIG. 8. The flexible substrate 13 has the terminal part 13*a* at one end thereof for connection with the connector 33 of the printer control substrate 31, and has a terminal part 13*b* at the other end thereof for connection with the head substrate 11 and the heat sink 17. The driver IC (not shown) is provided on a back face of the flexible substrate 13. Electronic components such as the platen detachment detection switch 22 and the sheet detection sensor 25 are attached through soldering to the flexible substrate 13. The flexible substrate 13 is connected through soldering to the sheet feed motor 23 at a terminal part 23*a* of the sheet feed motor 23.

In the thermal printer of the present embodiment, the platen detachment detection switch and the sheet detection sensor 25 are directly connected to the flexible substrate 13. Further, the flexible substrate 13 is connected to the terminal part 23*a* of the sheet feed motor 23. With this arrangement, there is no need to provide another printed substrate.

Moreover, a thermal head unit that can be manufactured at low cost is employed. The thermal printer can thus be manufactured at low cost.

Second Embodiment

Figure 9:
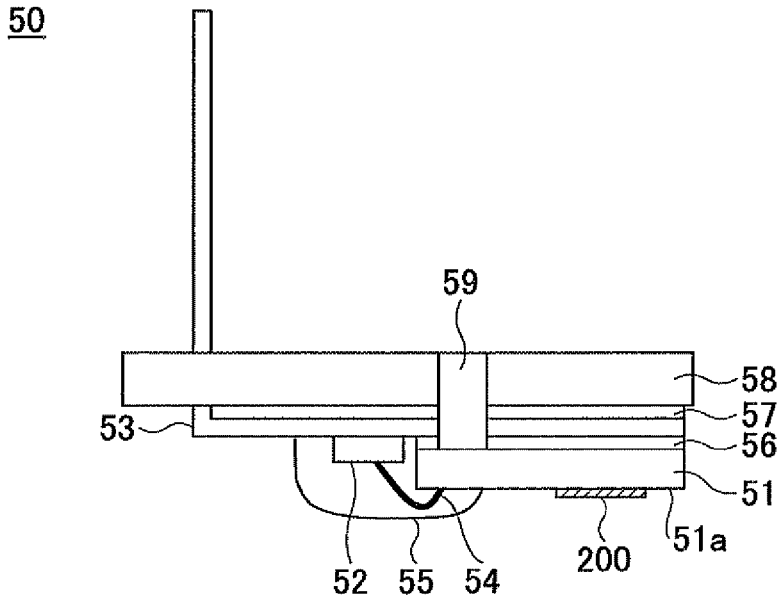
FIG. 9 is a drawing illustrating the configuration of a thermal head unit according to a second embodiment.

In the following, a second embodiment will be described. FIG. 9 is a drawing illustrating the configuration of a thermal head unit of the second embodiment.

In a thermal head unit 50 of the present embodiment, as in the thermal head unit 10 of the first embodiment, a heating element 200 is provided on a surface 51*a* of a head substrate 51 made of ceramics. A driver IC 52 drives the heating element 200 formed on the head substrate 51, and is mounted on a flexible substrate 53. The driver IC 52 and the flexible substrate 53 are electrically connected to each other. The driver IC 52 and the head substrate 51 are electrically connected to each other through wire bonding 54. The entirety of the driver IC 52 and wire bonding 54 is covered with an IC protective portion 55 made of resin material. The head substrate 51 is attached to the flexible substrate 53 through a double-faced adhesive tape 56. The flexible substrate 53 is also attached to a heat sink 58 through a double-faced adhesive tape 57. Further, a heat sink fixing part 59 made of resin material is provided to fix the heat sink 58 to the head substrate 51. The role of the heat sink fixing part 59 is auxiliary, and, thus, the heat sink fixing part 59 may only be provided as needed.

In the thermal head unit 50 of the present embodiment, as in the thermal head unit 10 of the first embodiment, there are no need to provide a metal plate to reinforce the wire bonding and no need to provide a printed substrate for mounting the driver IC 52, so that it is easy to reduce the size of the head substrate 51. The thermal head unit can thus be manufactured at low cost.

It should be noted that the thermal head unit 50 of the present embodiment may be employed in the thermal printer of the first embodiment. Configurations other than those described above are the same as or similar to those of the first embodiment.

Third Embodiment

Figure 10:
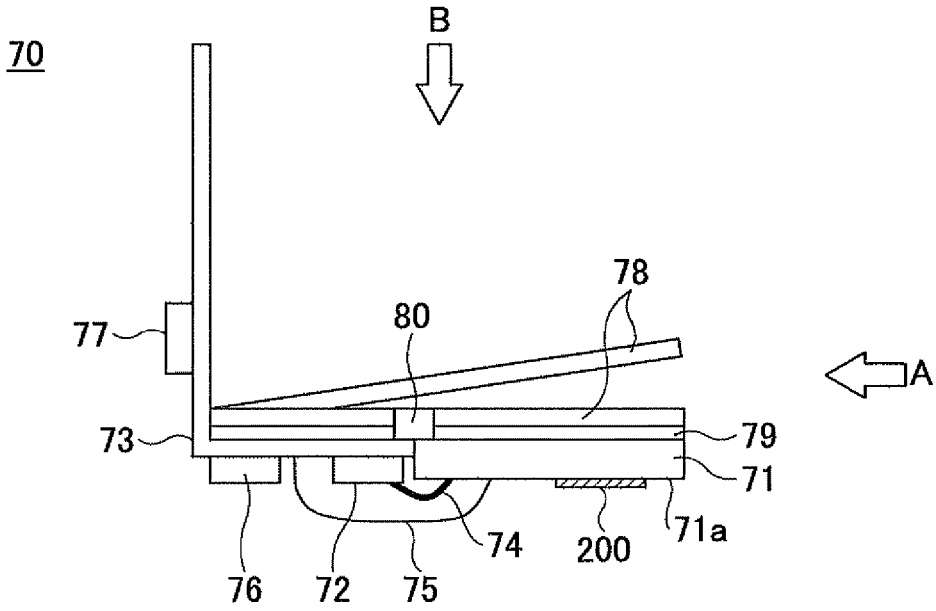
FIG. 10 is a drawing illustrating the configuration of a thermal head unit according to a third embodiment.

In the following, a third embodiment will be described. FIG. 10 is a drawing illustrating the configuration of a thermal head unit of the third embodiment.

In a thermal head unit 70 of the present embodiment, as in the thermal head unit of the first embodiment, a heating element 200 is provided on a surface 71*a* of a head substrate 71 made of ceramics. A driver IC 72 drives the heating element 200 formed on the head substrate 71, and is mounted on a flexible substrate 73. The driver IC 72 and the flexible substrate 73 are electrically connected to each other. The driver IC 72 and the head substrate 71 are electrically connected to each other through wire bonding 74. The entirety of the driver IC 72 and wire bonding 74 is covered with an IC protective portion 75 made of resin material. A sheet detection sensor 76 and a printer-control-purpose electronic component 77 are mounted on the flexible substrate 73.

Figure 6:
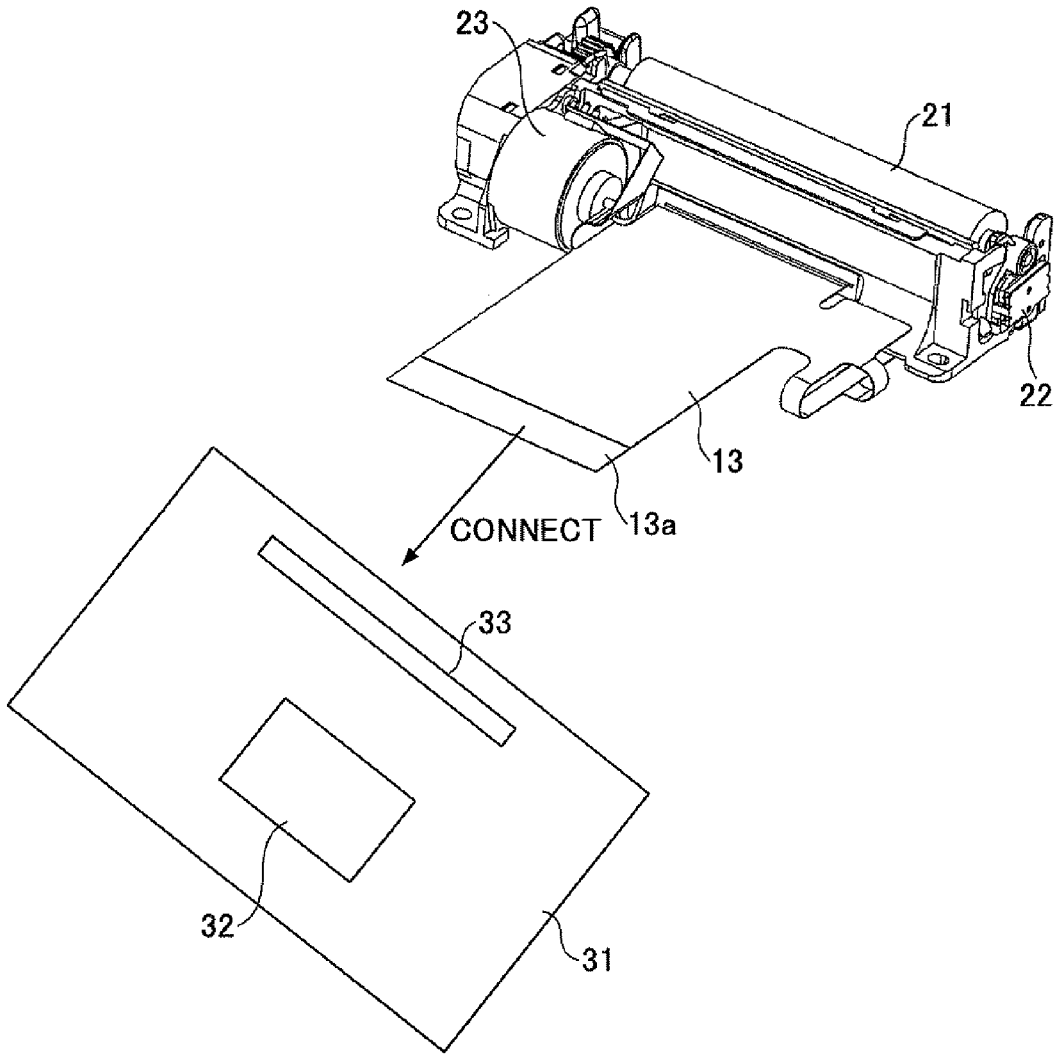
FIG. 6 is a perspective view of the thermal head unit according to the first embodiment.

The printer-control-purpose electronic component 77 may include a platen-detachment detection switch, a printer control IC, etc. In the first embodiment, electronic components such as the printer control IC 32 for controlling the thermal printer is mounted on the printer control substrate 31 as illustrated in FIG. 6. In the present embodiment, on the other hand, the printer control IC and the like may be mounted on the flexible substrate 73. With this arrangement, no printer control substrate is necessary, so that the thermal printer can be manufactured at low cost. As has been described above, one aspect of the present embodiment is directed to the arrangement of a printer control IC, which is provided as a control circuit for controlling a thermal printer. Notwithstanding the above description, the printer control IC may alternatively be mounted on a printer control substrate.

In the thermal head unit 70 of the present embodiment, a spring heat sink 78 is provided. The spring heat sink 78 serves both the function of the heat sink 17 and the function of the head pressurizing spring 24 provided in the thermal head unit 10 of the first embodiment. The spring heat sink 78 is made of metal material such as stainless steel, and is formed in such a shape as to function as a spring.

The spring heat sink 78 is attached to the head substrate 71 and the flexible substrate 73 through a double-faced adhesive tape 79. Further, a heat sink fixing part 80 made of resin material is provided to fix the spring heat sink 78 to the head substrate 71 and to the flexible substrate 73. The role of the heat sink fixing part 80 is auxiliary, and, thus, the heat sink fixing part 80 may only be provided as needed.

Figure 7:
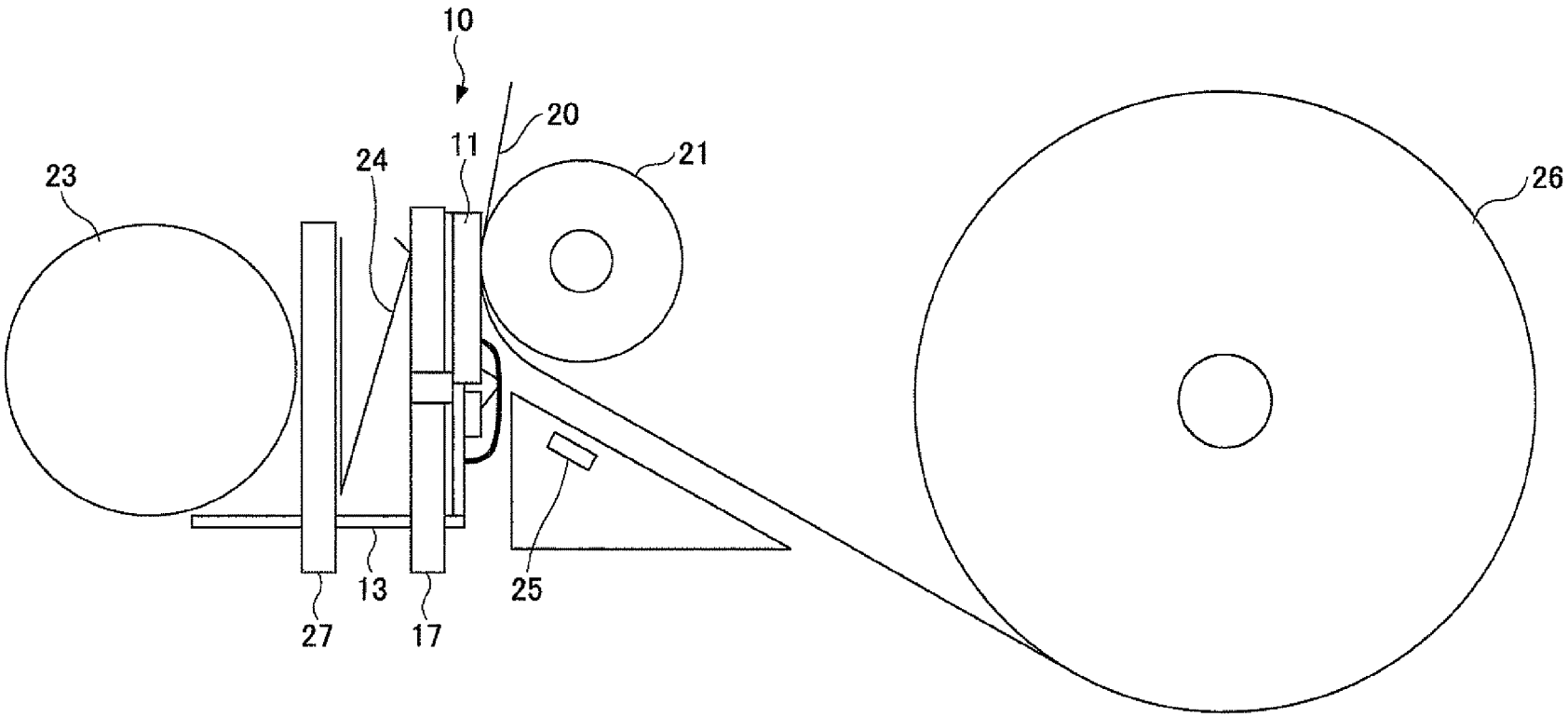
FIG. 7 is a drawing illustrating the configuration of a thermal printer according to the first embodiment.

The spring heat sink 78 is arranged such that its part that is not attached to the head substrate 71 is in contact with the plate-shape part 27 of the chassis of the thermal printer illustrated in FIG. 7. With this provision, the head substrate 71 is properly pressed against the platen roller without using the head pressurizing spring 24 illustrated in FIG. 7.

Figure 11A:
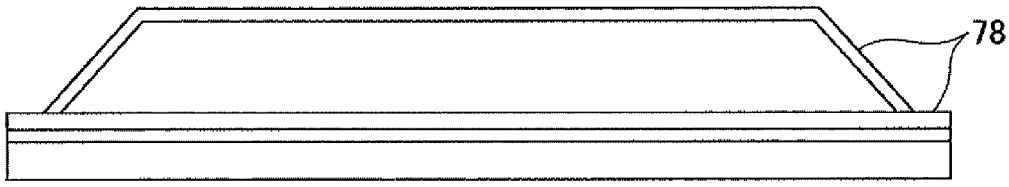
FIGS. 11A and 11B are drawings illustrating a first embodiment of a spring heat sink shown in FIG. 10.
Figure 11B:
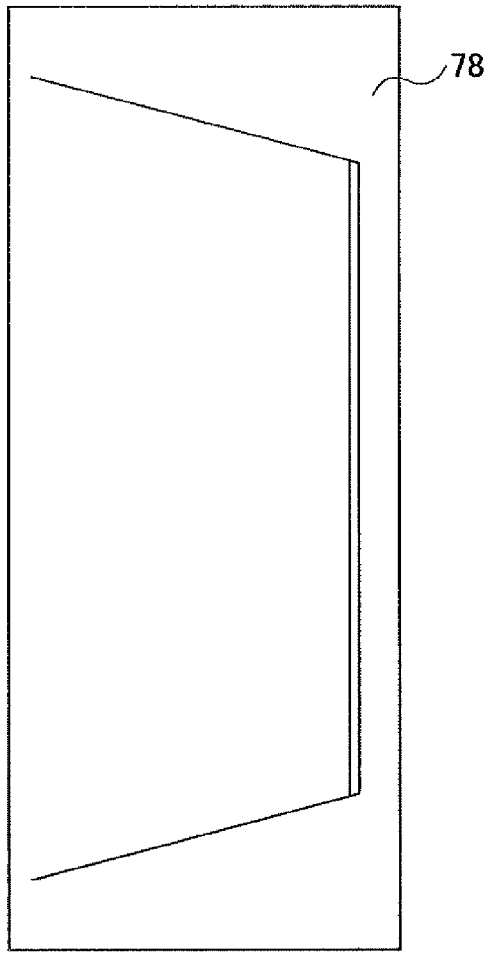

FIGS. 11A and 11B are drawings illustrating a first embodiment of the spring heat sink 78. FIG. 11A illustrates the spring heat sink 78 as viewed from the direction A shown in FIG. 10. FIG. 11B illustrates the spring heat sink 78 as viewed from the direction B shown in FIG. 10.

Figure 11C:
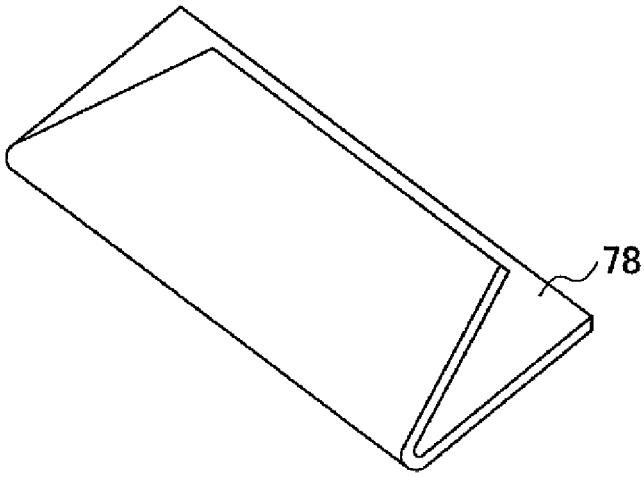
FIGS. 11C and 11D are perspective views of two variations of the spring heat sink shown in FIGS. 11A and 11B.
Figure 11D:
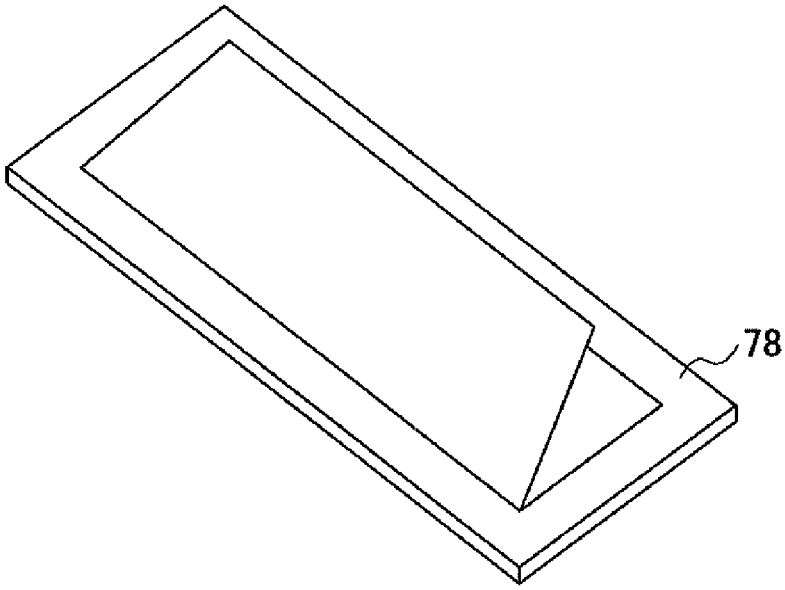

FIGS. 11C and 11D are perspective views of two variations of the spring heat sink 78 shown in FIGS. 11A and 11B. As illustrated in FIG. 11C, a spring heat sink 78 may be manufactured by folding a metal plate. Alternatively, as illustrated in FIG. 11D, a spring heat sink 78 may be manufactured by cutting a metal plate along three sides of a rectangle area situated at the center of the plate and raising the center portion by folding it along the remaining side of the rectangle area.

Figure 12A:
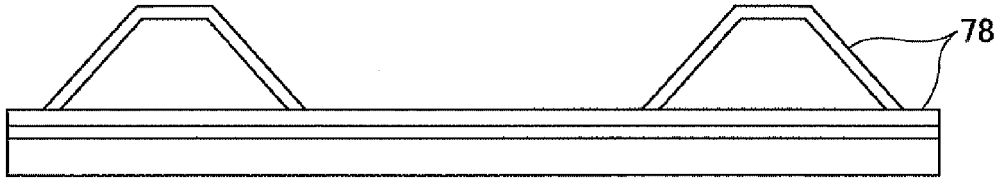
FIGS. 12A and 12B are drawings illustrating a second embodiment of the spring heat sink shown in FIG. 10.
Figure 12B:
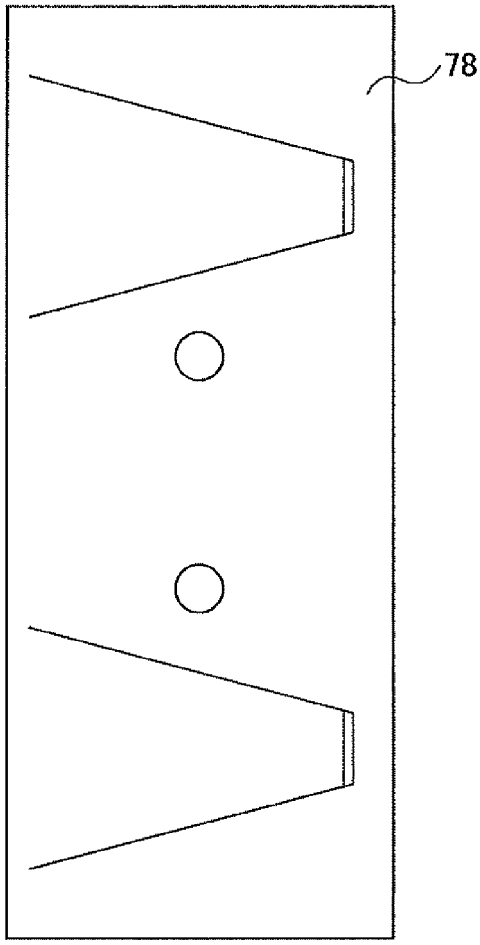

FIGS. 12A and 12B are drawings illustrating a second embodiment of the spring heat sink 78. FIG. 12A illustrates the spring heat sink 78 as viewed from the direction A shown in FIG. 10. FIG. 12B illustrates the spring heat sink 78 as viewed from the direction B shown in FIG. 10. The spring heat sink 78 in this example has two flaps that come in contact with the plate-shape part 27 of the chassis of the thermal printer illustrated in FIG. 7.

Figure 12C:
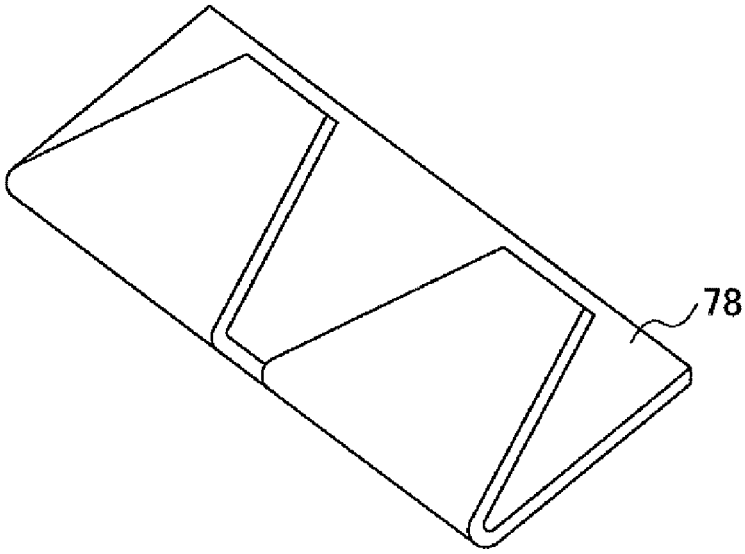
FIGS. 12C and 12D are perspective views of two variations of the spring heat sink shown in FIGS. 12A and 12B.
Figure 12D:
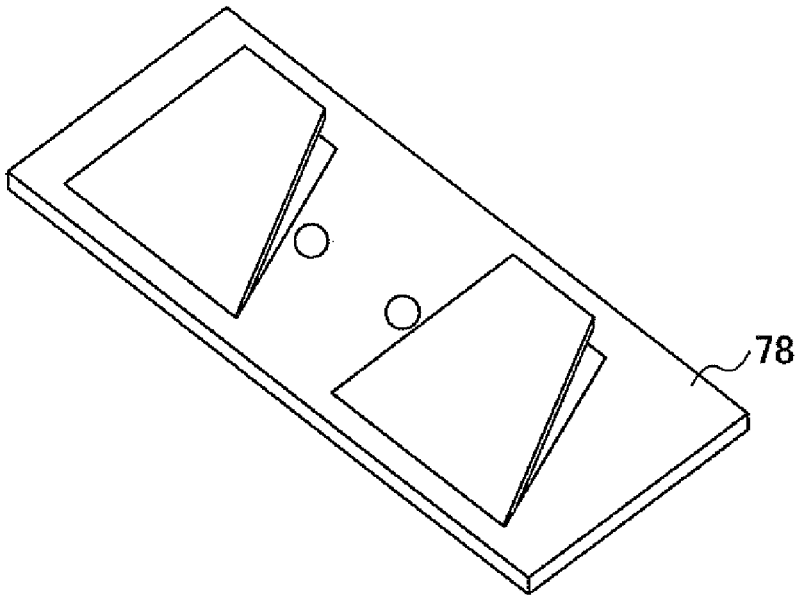

FIGS. 12C and 12D are perspective views of two variations of the spring heat sink 78 shown in FIGS. 12A and 12B. As illustrated in FIG. 12C, a spring heat sink 78 may be manufactured by folding two flaps of a metal plate. Alternatively, as illustrated in FIG. 120, a spring heat sink 78 may be manufactured by cutting a metal plate along three sides of two trapezoids situated near the respective opposite ends of the plate and raising the interior portions by folding them along the remaining side of the trapezoids.

In the thermal head unit 70 of the present embodiment, the spring heat sink 78 having both the function of a heat sink and the function of a head pressurizing spring is provided. This can further reduce the number of components of the thermal printer. The number of steps in the production process can also be reduced. The thermal printer can thus be manufactured at low cost.

It should be noted that the thermal head unit of the present embodiment may be employed in the thermal printer of the first embodiment. Configurations other than those described above are the same as or similar to those of the first embodiment.

Further, the present invention is not limited to these embodiments, but various variations and modifications may be made without departing from the scope of the present invention.

The present application is based on Japanese priority application No. 2009-146539 filed on Jun. 19, 2009, with the Japanese Patent Office, the entire contents of which are hereby incorporated by reference.

What is claimed is:

1. A thermal head unit, comprising:

a head substrate having a heating element serving as a thermal head formed thereon;

a flexible substrate;

a driver IC disposed on the flexible substrate to drive the thermal head; and a heat sink attached to the head substrate and to the flexible substrate, the flexible substrate being directly attached to the heat sink without an intervening substrate therebetween, wherein the driver IC and the flexible substrate are electrically connected to each other, and the driver IC and the head substrate are electrically connected to each other.

2. The thermal head unit as claimed in claim 1, wherein the driver IC and the head substrate are connected through one of wire bonding, solder, and anisotropic conductive film.

3. The thermal head unit as claimed in claim 1, further comprising an electronic component disposed on the flexible substrate, wherein the flexible substrate and the electronic component are electrically connected to each other.

4. The thermal head unit as claimed in claim 3, wherein the electronic component is at least one of a sheet detection sensor and a platen-detachment detection switch.

5. The thermal head unit as claimed in claim 1, wherein the heat sink serves as a spring.

6. A thermal printer, comprising:

a thermal head unit;

a platen roller; and a sheet feed motor, wherein the thermal head unit includes:

a head substrate having a heating element serving as a thermal head formed thereon;

a flexible substrate;

a driver IC disposed on the flexible substrate to drive the thermal head; and a heat sink attached to the head substrate and to the flexible substrate, the flexible substrate being directly attached to the heat sink without an intervening substrate therebetween, wherein the driver IC and the flexible substrate are electrically connected to each other, and the driver IC and the head substrate are electrically connected to each other.

7. The thermal printer as claimed in claim 6, further comprising:

a control substrate;

a control circuit disposed on the control substrate to control the thermal printer; and a connector attached to the control substrate, wherein the connector is connected to a terminal part of the flexible substrate to provide electrical connection between the flexible substrate and the control circuit.

8. The thermal printer as claimed in claim 6, further comprising a control circuit disposed on the flexible substrate to control the thermal printer, wherein the flexible substrate and the control circuit are electrically connected to each other.

9. The thermal printer as claimed in claim 6, wherein a terminal part of the sheet feed motor and the flexible substrate are electrically connected to each other through solder.

10. The thermal printer as claimed in claim 6, wherein the heat sink serves as a spring to press the head substrate against the platen roller.

11. The thermal head unit as claimed in claim 1, wherein the head substrate is situated above the flexible substrate.

* * * * *